US008274537B2

(12) United States Patent
Howell et al.

(10) Patent No.: US 8,274,537 B2
(45) Date of Patent: Sep. 25, 2012

(54) THERMAL TRANSFER PRINTING

(75) Inventors: Jeffrey Michael Howell, Ipswich (GB); Peter Charles William Butcher, Tollesbury (GB)

(73) Assignee: Akzo Nobel Coatings International B.V., Arnhem (NL)

( * ) Notice: Subject to any disclaimer, the term of this patent is extended or adjusted under 35 U.S.C. 154(b) by 331 days.

(21) Appl. No.: 12/663,390

(22) PCT Filed: Jun. 6, 2008

(86) PCT No.: PCT/GB2008/001931

§ 371 (c)(1),
(2), (4) Date: Dec. 7, 2009

(87) PCT Pub. No.: WO2008/149099

PCT Pub. Date: Dec. 11, 2008

(65) Prior Publication Data

US 2010/0220169 A1 Sep. 2, 2010

(30) Foreign Application Priority Data

Jun. 8, 2007 (GB) ..... 0711052.1

(51) Int. Cl.
*B41J 2/38* (2006.01)

(52) U.S. Cl. ..... 347/186

(58) Field of Classification Search ..... 347/186, 347/217, 215, 213, 221, 222
See application file for complete search history.

(56) References Cited

U.S. PATENT DOCUMENTS 5,997,678 A 12/1999 Wess et al.

FOREIGN PATENT DOCUMENTS

| | | |
|---|---|---|
| WO | WO 98/02315 | 1/1998 |
| WO | WO 01/96123 | 12/2001 |
| WO | WO 02/079566 | 10/2002 |
| WO | WO 02/096661 | 12/2002 |
| WO | WO 2004/022354 | 3/2004 |
| WO | WO 2006/050902 | 5/2006 |
| WO | WO 2007/049070 | 5/2007 |

OTHER PUBLICATIONS

International Search Report and Written Opinion, PCT International Application PCT/GB2008/001931, mailed Oct. 20, 2008.
Response to Written Opinion, PCT International Application PCT/GB2008/001931, dated Feb. 25, 2008.
International Preliminary Report on Patentability, PCT International Application PCT/GB2008/001931, mailed Aug. 11, 2009.

*Primary Examiner* — Kristal Feggins
(74) *Attorney, Agent, or Firm* — Kenyon & Kenyon LLP

(57) ABSTRACT

Apparatus for thermal transfer printing of an image from a thermal retransfer sheet onto an article, includes heating means (40, 42, 44, 46) adapted to supply heated gas at a variable flow rate. Also disclosed is a method of printing an image, and the resulting printed article.

12 Claims, 4 Drawing Sheets

THERMAL TRANSFER PRINTING

FIELD OF THE INVENTION

This invention relates to thermal transfer printing, and concerns apparatus for thermal transfer printing of an image from a retransfer intermediate sheet onto an article, a method of printing and an article bearing a printed image.

BACKGROUND TO THE INVENTION

Thermal retransfer printing involves forming an image (in reverse) on a retransfer intermediate sheet using one or more thermally transferable dyes. The image is then thermally transferred to a surface of an article by bringing the image into contact with the article surface and applying heat and possibly also pressure. Thermal transfer printing is particularly useful for printing onto articles that are not readily susceptible of being printed on directly, particularly three dimensional objects. Thermal retransfer printing by dye diffusion thermal transfer printing, using sublimation dyes, is disclosed, e.g., in WO 98/02315 and WO 02/096661. By using digital printing techniques to form the image on the retransfer intermediate sheet, high quality images, possibly of photographic quality, can be printed on three dimensional (3D) articles relatively conveniently and economically even in short runs. Indeed such objects can be personalised economically.

Using suitable retransfer intermediate sheets, it is possible to form good quality images on 3D articles, possibly having complex shapes including curved shapes (concave or convex) including compound curves. When printing onto 3D articles, the sheet is typically preheated, e.g. to a temperature in the range 80 to 170° C., prior to application to the article, to soften the sheet and render it deformable. The softened sheet is then in a condition in which it can be easily applied to and conform to the contours of an article. This is conveniently effected by application of a vacuum to cause the softened sheet to mould to the article. While the sheet is maintained in contact with the article, e.g. by maintenance of the vacuum, the sheet, and possibly also the article, is heated to a suitable temperature for dye transfer, typically a temperature in the range 140 to 200° C., for a suitable time, typically in the range 15 to 150 seconds. After dye transfer, the article is allowed or caused to cool before removal of the retransfer intermediate sheet. Suitable apparatus for performing the retransfer printing step is disclosed e.g. in WO 01/96123 and WO 2004/022354.

Heating of the film is conveniently effected by exposure to a stream of hot air generated from heating means comprising a fan and heater elements. In the sheet preheating stage, the heated sheet is softened and becomes viscoelastic with a very low yield stress. This means there is a risk of the force of the hot air deforming and distorting the film, causing the film to balloon out downwardly. Such distortion is undesirable as it adversely affects registration of the image on the sheet with the article and image fidelity.

SUMMARY OF THE INVENTION

In one aspect, the present invention provides apparatus for thermal transfer printing of an image from a thermal retransfer sheet onto an article, wherein the apparatus includes heating means adapted to supply heated gas at a variable flow rate.

By being able to generate heated gas at variable flow rates, it is possible to use the apparatus by carrying out preheating of a sheet at a low flow rate, sufficient to heat the sheet to a softened condition without causing undesirable distortion of the sheet. During the later dye transfer step, when the sheet has been brought into intimate contact with the article (typically by use of vacuum forming means), a high gas flow rate (possibly of hotter gas) can be used to provide efficient and rapid heat input to the sheet and article, overcoming the thermal mass of the article (and possibly also of a support for the article). The sheet alone has a relatively low thermal mass so in the preheating step a low gas flow rate is effective to heat the sheet, while the thermal mass of the sheet, article and possibly also support is much higher so in the dye transfer step a high gas flow rate is beneficial for rapid heating and hence dye transfer.

The heating means conveniently comprise a heater element and a variable speed fan. The heating means desirably includes an inverter for varying the power supplied to the fan.

The heating means is operable to cause preheating of the sheet (typically to a temperature in the range 80 to 170° C.) to soften the sheet (low flow rate), and also for heating the sheet (typically to a temperature in the range 120 to 240° C., commonly about 160° C.) to cause dye transfer (high flow rate). The heating means may also be used for optional preheating of articles to be treated (typically to a temperature in the range 100 to 120° C.) (high flow rate).

The heated gas is commonly air.

The apparatus may otherwise be of conventional construction and may be used in a conventional manner.

The apparatus includes means for bringing the sheet and article into intimate contact ready for the dye transfer step. Such means typically comprise vacuum means, with the apparatus thus being a vacuum press. The vacuum means conveniently comprises a vacuum pump and associated bleed valve.

The apparatus typically includes a support for holding one or more articles to be printed, including optional nests or moulds shaped to be complementary to the items to be printed on, to act as a support therefor and prevent distortion of items such as thin-walled plastics articles that might otherwise distort on heating.

The apparatus suitably includes means for holding a thermal retransfer sheet in position, over an article to be printed on.

Means are desirably provided for causing relative movement between the article and sheet, to bring the sheet (in softened condition after preheating) and article into contact, with the support conveniently including elevating means for raising and lowering the support.

The apparatus conveniently includes cooling means, typically in the form of a fan for directing a flow of cold air over the article and sheet after printing for cooling both.

The apparatus suitably includes computer control means for regulating operation of the heating means (temperature and gas flow rate), vacuum means, cooling means and elevating means. The control means may include a number of preset programs suitable for printing a variety of different materials, and may also be programmable by a user to suit other requirements.

The apparatus can be used to print images onto articles made of a wide range of materials including plastics, metal, ceramics, wood, composite materials etc. with the articles being of solid or thin-walled construction. Depending on the nature of the surface of the article on which the image is to be printed, it may be appropriate to pre-treat the surface by application of a surface coating or lacquer to improve the take up of transferred dyes.

The apparatus is particularly intended for printing onto 3D articles, possibly having complex shapes including curved shapes (concave or convex) including compound curves.

Suitable thermal retransfer sheets are commercially available, such as Pictaflex media (Pictaflex is a Trade Mark) from ICI Imagedata.

Images may be formed on the retransfer sheet by printing with suitable thermally transferable dyes, preferably by inkjet printing.

In a further aspect, the present invention provides a method of printing an image from a thermal retransfer sheet onto an article, comprising preheating the sheet by exposure to heated gas at a first, lower flow rate; causing the preheated sheet and article to come into contact; and heating the sheet further by exposure to heated gas at a second, higher flow rate to cause dye transfer from the sheet to the article.

The first, lower flow rate is suitably less than or equal to 50% of the second, higher flow rate, desirably being about 40% of the second flow rate.

The gas flow rate is conveniently varied by varying the speed of a fan forming part of heating means. Fan speed may be readily controlled by varying the power or frequency supplied to the fan, e.g. via an inverter under suitable control. For the first flow rate the fan is suitably run at 40% or 20% of its intended design speed and for the second flow rate the fan is suitably run at 100% of its intended design speed.

The method may include an optional step of preheating the articles. This is suitably carried out at a high gas flow rate, e.g. the second rate, for efficiency.

The preheated sheet and article are conveniently caused to come into contact by exposure to a vacuum. The vacuum is suitably at a level in the range 30 to 85 kPa (e.g. about 50 kPa) below atmospheric.

The method typically includes a final cooling step.

Preheating of the articles is typically at a temperature in the range 100 to 120° C. for about 30 seconds, with conditions depending on the material of the surface of the article to be printed using the higher gas flow rate.

Preheating of the sheet is typically at a temperature in the range 80 to 170° C. for about 30 seconds, with a temperature of about 145° C. or 130° C. for 30 seconds being suitable for Pictaflex media, using the lower gas flow rate.

Dye transfer is typically effected by heating at a temperature in the range 120 to 240° C., commonly about 160° C., for a time in the range 15 seconds to 5 minutes, with conditions depending on factors including the dyes, film and article, using the higher gas flow rate.

The invention also includes within its scope an article bearing a printed image produced by the apparatus or method of the invention.

An embodiment of a vacuum press in accordance with the invention for thermal transfer printing of an image from a thermal retransfer intermediate sheet on to a 3D article will now be described, by way of illustration, with reference to the accompanying drawings, in which.

DETAILED DESCRIPTION OF THE DRAWINGS

Figure 1:
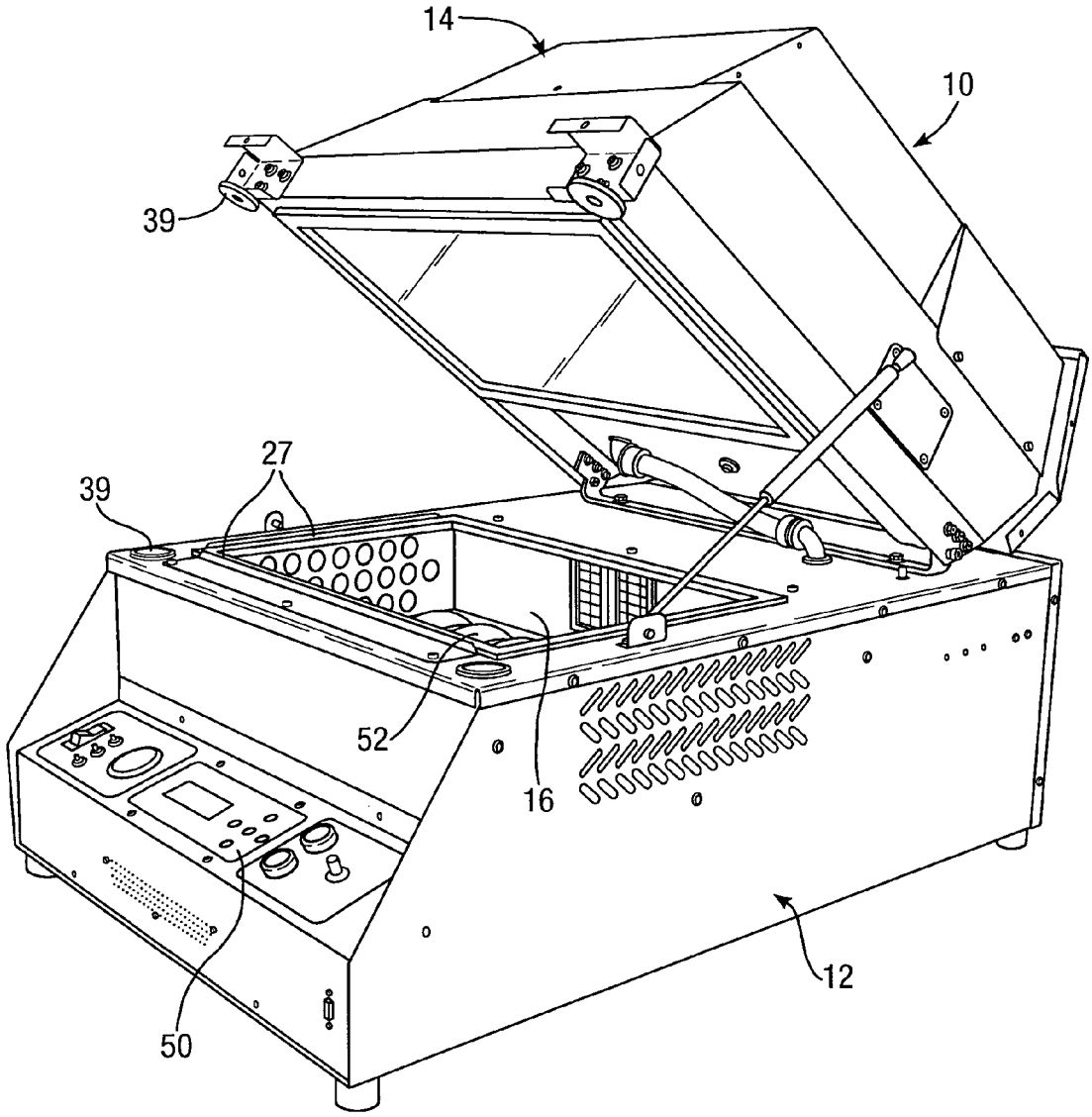
FIGS. 1 and 2 are perspective drawings of the vacuum press.
Figure 2:
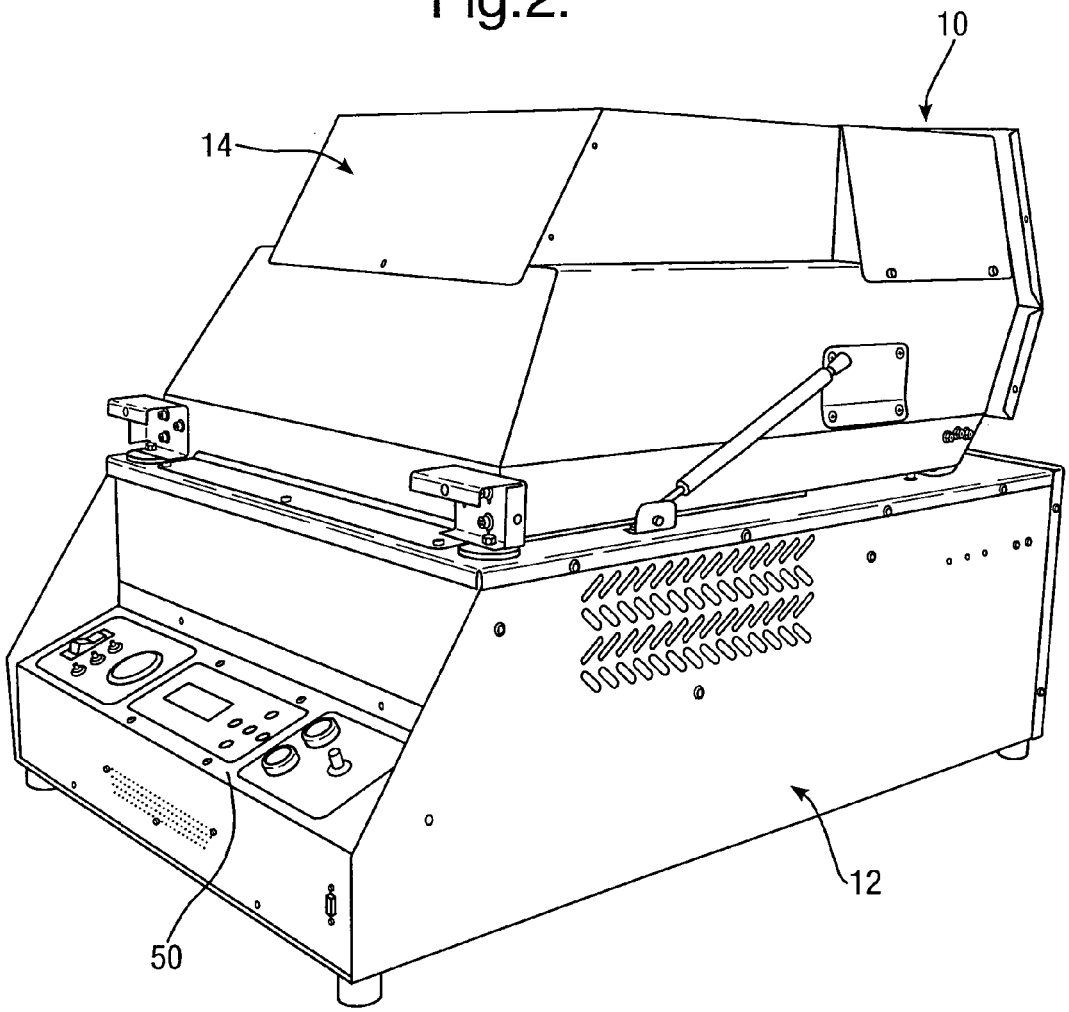

The illustrated vacuum press 10 is in the form of an A3 format desktop unit designed for use with an A3 retransfer sheet. The press is of generally cuboid shape, with overall dimensions of 800 mm depth, 600 mm height and 600 mm width. The press comprises a housing having a base unit 12 and a lid unit 14 hingedly connected thereto at the rear, with the lid unit being movable manually between an initial open position (as shown in FIG. 1) and a closed position for use (as shown in FIG. 2).

Figure 3:
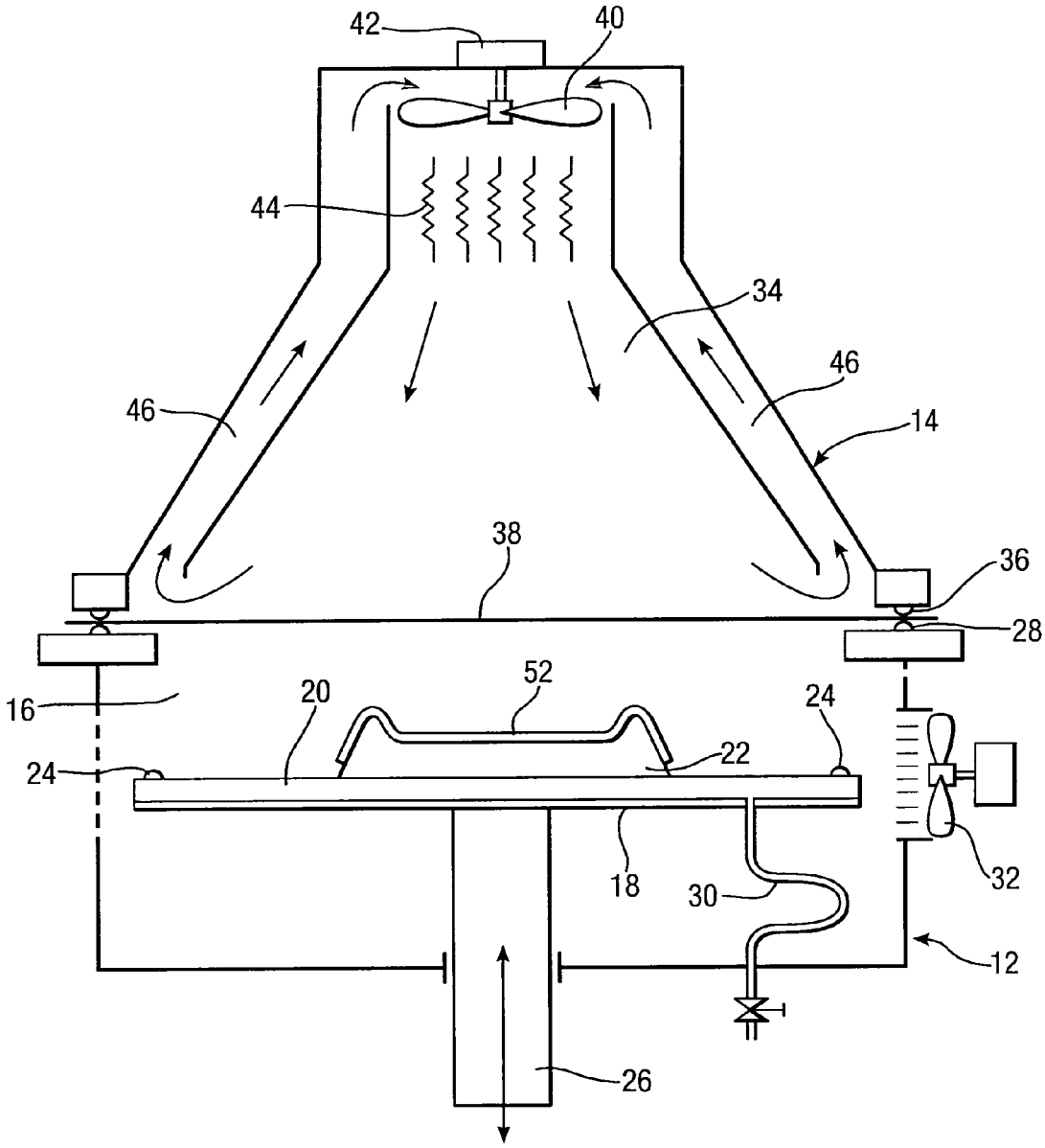
FIG. 3 is a schematic sectional view of internal components of the press.
Figure 4:
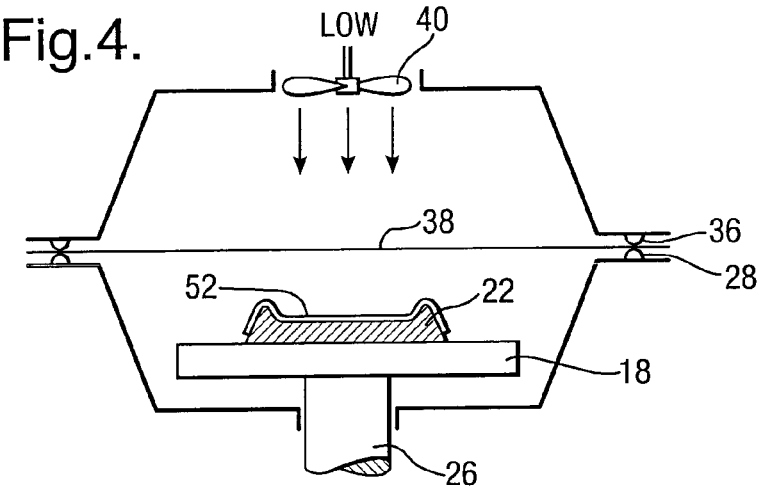
FIGS. 4 to 6 are schematic sectional views of internal components of the press at different stages in operation.
Figure 5:
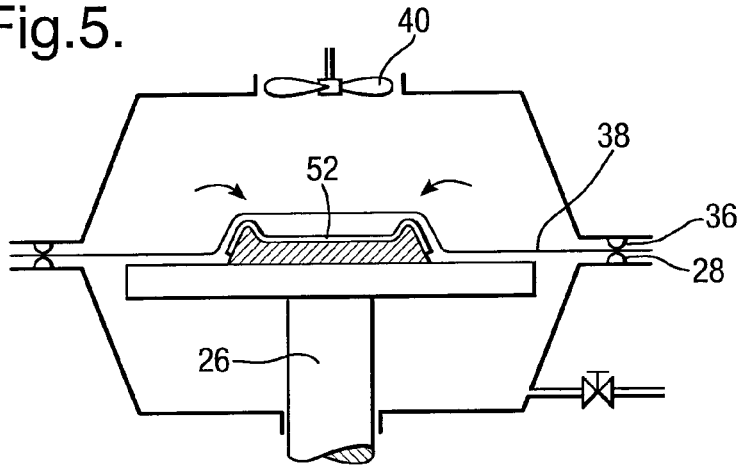
Figure 6:
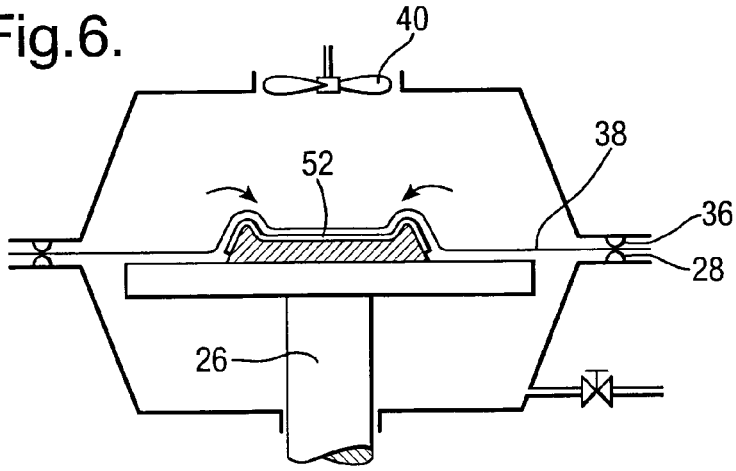

The base unit includes a recess 16 in which is located a table 18 for receiving an array of 3D articles to be printed on or decorated. Resting on table 18 is a nest plate 20 of porous aluminium or fibre carrying an array of nests or moulds 22 (only one of which is shown for simplicity in FIGS. 3 to 6) shaped to be complementary to the items to be printed on, to act as a support therefor and prevent distortion of items such as thin-walled plastics articles that might otherwise occur on heating. A peripheral rubber seal 24 is provided on the upper surface of the nest plate 20 to seal within the base unit. Table 18 can be raised and lowered on a shaft 26 by a lifting cylinder mechanism (not shown) from an initial lowered position (as shown in FIGS. 1, 3 and 4) to a raised position (as shown in FIGS. 5 to 6).

The periphery of the recess 16 is surrounded by linear film guides 27 (visible in FIG. 1) for accurately locating an A3 retransfer sheet in position over the recess and retaining the sheet in position, resting on a peripheral rubber seal 28.

The base unit 12 includes a vacuum system including a vacuum pump and bleed valve (not shown) for generating a vacuum in a flexible hose 30 that passes through table 18 to draw air out from immediately beneath the nest plate 20.

The base unit also includes a cooling fan 32 with associated electric motor.

The lid unit 14 includes a recess 34 the periphery of which is surrounded by a rubber seal 36 that cooperates with the seal 28 of the base unit to secure and seal a retransfer sheet 38 therebetween in the housing when the lid unit is in the closed position. Magnetic locks 39 (visible in FIG. 1) are provided for securing the lid unit in the closed position.

The lid unit 14 includes heating means comprising a variable speed fan 40 with associated motor 42 and downstream electrical heater elements 44 for directing a flow of hot air downwardly in the lid unit, with the air passing upwardly through channels 46 to be recirculated within the housing. Fan 40 receives power from an inverter (not shown) capable of regulating the power supplied to the fan under computer control.

The apparatus includes computer control means (not shown) and a control panel 50 including display means at the front of the base unit, visible in FIGS. 1 and 2.

In use, an image to be printed on a 3D article is printed (in reverse) onto a suitable retransfer intermediate sheet 38. In one embodiment an image is printed onto Pictaflex A3+ roll media from ICI Imagedata (Pictaflex is a Trade Mark) by an inkjet printing process on an Epson 4400 printer (Epson is a Trade Mark) using Artainium dye sublimation inks (Artainium is a Trade Mark), cut to A3 sheet size and allowed to dry.

Items to be printed on, represented by article 52, are placed in the base unit 12, each resting on a respective nest 22, with the surface to be decorated uppermost. Depending on the nature of the surface of the article on which the image is to be formed, it may be appropriate to pretreat the surface by application of a surface coating or lacquer to improve the take up of transferred dyes.

The lid unit 14 is moved manually to the closed position.

The heating means is activated in an article preheating step, with the fan 40 causing hot air at a temperature of about 110° C. to be recirculated within the housing for about 30 seconds. The fan is run at 100% of its intended design speed for rapid heating. This acts to preheat the articles to be decorated.

The lid unit 14 is then manually moved to the open position.

The printed A3 Pictaflex film sheet 38 is placed in position on the base unit 12 over recess 16 within the guides and resting on the seal 28, with the printed side facing the article. The lid unit is manually moved to the closed position, being retained by the magnetic lock, sealing sheet 38 in position between seals 28 and seals 36, as shown in FIGS. 3 and 4.

In a film preheating step, the heating means is activated, with the fan causing hot air at a temperature of about 145° C. to be recirculated within the apparatus for about 30 seconds. At this temperature the film sheet 38 softens and becomes viscoelastic and has a very low yield stress. The fan is run at 40% of its intended design speed in the film preheating step to prevent unwanted distortion and ballooning of the softened film.

While maintaining heating, the table 18 is raised so that article 52 passes through the softened film 38, as shown in FIG. 5, with the film being loosely draped around the article.

In a vacuum step, while maintaining heating the vacuum system in the base unit 12 is then operated, generating a vacuum of 15 inches Hg (about 50 kPa) below atmospheric beneath the film, via hose 30, which acts to draw the film against the article, as shown in FIG. 5, with the seals 24 and 28 acting to maintain a vacuum. The softened film conforms to the shape of the article 52. The temperature of the heating means is raised in a dye transfer step to generate hot air at a temperature of about 160° C., with the temperature being held at this level for about 120 seconds and the fan being run at 100% of its intended design speed for efficient heat transfer. At this elevated temperature dye diffuses from the film into the adjacent surface of the article.

In accordance with the invention, a low fan speed is used when preheating the sheet to avoid causing undesirable distortion and ballooning of the softened sheet, which is viscoelastic and has a very low yield stress. The low thermal mass of the suspended film means that a low gas flow rate is nevertheless easily capable of bringing the sheet quickly up to the desired temperature. At other stages, the full fan speed is used to give rapid heat input for transfer, both when preheating the articles and in the dye transfer step as the higher thermal mass of the article and supporting nest must be overcome.

The table 18 is lowered after an appropriate time, and the vacuum released. In a cooling, step, cold air is blown upwardly in the base unit 12 by the cooling fan 32 for about 20 seconds to impinge on the articles 52 from below. This acts to cool the articles and sheet.

The lid unit 14 is then manually moved to the open position. The film sheet 38 is removed and discarded and the articles 52 removed.

Operation of the heating means (temperature and fan speed), vacuum system and cooling fan are under the control of the computer control means. The apparatus includes a number of preset programs suitable for a printing a variety of different materials, and is also programmable by a user to suit other requirements.

Example 1

A test image was created with blocks of ascending density (25%, 50%, 75%, 100%) on a uniform mid-grey background. A sheet of Pictaflex film was printed with this test image using Artainium UV+ inks in a Mimaki JV5-130S inkjet printer (Mimaki is a Trade Mark). This image was transferred to a polyester-coated 0.5 mm thick sheet of aluminium in a press as described above. The press conditions were as follows:

| | Test number | | | |
|---|---|---|---|---|
| | 1 | 2 | 3 | 4 |
| Preheat | none | none | none | none |
| Film softening | 30 s at 145° C. | 30 s at 145° C. | 30 s at 145° C. | 30 s at 145° C. |
| Film softening fan RPM | 1050 | 1050 | 2700 | 2700 |
| Image transfer | 120 s at 170° C. | 120 s at 180° C. | 120 s at 170° C. | 120 s at 180° C. |
| Image transfer fan RPM | 1050 | 1050 | 2700 | 2700 |

The optical density (OD) of the steps in the transferred images was measured and mean value recorded thus:

| | Test number | | | |
|---|---|---|---|---|
| | 1 | 2 | 3 | 4 |
| 25% | 0.18 | 0.22 | 0.32 | 0.315 |
| 50% | 0.295 | 0.39 | 0.64 | 0.64 |
| 75% | 0.4 | 0.535 | 1.045 | 1.115 |
| 100% | 0.57 | 0.795 | 1.595 | 1.775 |

This shows that a high level of dye transfer is only possible at the highest fan speed, irrespective of the air temperature during image transfer.

Example 2

A test image was created with solid narrow vertical and horizontal black lines arranged in a uniform half-inch grid pattern. A sheet of Pictaflex film was printed with this test image using Artainium UV+ inks in a Mimaki JV5-130S inkjet printer. This image was transferred to a polyester-coated 0.5 mm thick sheet of aluminium in a press as described above. The press conditions were as follows:

| | Test number | | |
|---|---|---|---|
| | 1 | 2 | 3 |
| Preheat | none | none | none |
| Film softening | 30 s at 145° C. | 30 s at 145° C. | 30 s at 145° C. |
| Film softening fan RPM | 1050 | 2100 | 2700 |
| Image transfer | 120 s at 180° C. | 120 s at 180° C. | 120 s at 180° C. |
| Image transfer fan RPM | 2700 | 2700 | 2700 |

-continued

| | Test number | | |
|---|---|---|---|
| | 1 | 2 | 3 |

The percentage increase in width and height of the transferred image was measured.

| | Test number | | |
|---|---|---|---|
| | 1 | 2 | 3 |
| width | 0.0 | 0.7 | 2.1 |
| height | 0.4 | 3.1 | 5.5 |

This shows that a low fan speed during the film softening stage avoids distortion of the image.

The invention claimed is:

1. An apparatus for thermal transfer printing of an image from a thermal retransfer sheet onto an article, wherein the apparatus includes a heater element and a variable speed fan adapted to supply heated gas at a variable flow rate.

2. The apparatus according to claim 1, wherein the heater element includes an inverter for varying the power supplied to the fan.

3. The apparatus according to claim 1, further including vacuum means for bringing the sheet and the article into contact.

4. The apparatus according to claim 1, further including a support for holding one or more articles to be printed including optional nests or moulds shaped to be complementary to the items to be printed on.

5. The apparatus according to claim 1, further including a means for causing relative movement between the article and sheet, to bring the sheet and article into contact.

6. The apparatus according to claim 1, further including a computer control means for regulating operation of at least the heater element including gas flow rate.

7. A method of printing an image from a thermal retransfer sheet onto an article, comprising preheating the sheet by exposure to heated gas at a first, lower flow rate; causing the preheated sheet and article to come into contact; and heating the sheet further by exposure to heated gas at a second, higher flow rate to cause dye transfer from the sheet to the article, wherein the gas flow rate is controlled by varying the speed of a fan of heating means.

8. The method according to claim 7, wherein the first flow rate is less than or equal to 50% of the second flow rate.

9. The method according to claim 8, wherein the first flow rate is about 40% of the second flow rate.

10. The method according to claim 7, wherein the fan speed is controlled by varying the power supplied to the fan.

11. The method according to claim 7, wherein the sheet is preheated at a temperature in the range 80 to 170° C. for about 30 seconds.

12. The method according to claim 7, wherein the preheated sheet and article are caused to come into contact by exposure to a vacuum.

* * * * *